US008096813B2

(12) United States Patent
Biggs

(10) Patent No.: US 8,096,813 B2
(45) Date of Patent: Jan. 17, 2012

(54) METHOD, KIT, AND AN ASSOCIATED ADAPTOR, USABLE WITH A HOSPITAL BED

(75) Inventor: Michael L. Biggs, Candler, NC (US)

(73) Assignee: Michael M. Biggs, Candler, NC (US)

( * ) Notice: Subject to any disclaimer, the term of this patent is extended or adjusted under 35 U.S.C. 154(b) by 0 days.

(21) Appl. No.: 12/880,149

(22) Filed: Sep. 12, 2010

(65) Prior Publication Data

US 2011/0005072 A1 Jan. 13, 2011

Related U.S. Application Data

(63) Continuation-in-part of application No. 12/459,484, filed on Jul. 2, 2009, now abandoned.

(51) Int. Cl.
*H01R 12/00* (2006.01)

(52) U.S. Cl. ..... 439/76.1

(58) Field of Classification Search ..... 439/76.1, 439/493, 498, 502, 623, 638
See application file for complete search history.

(56) References Cited

U.S. PATENT DOCUMENTS 3,666,886 A * 5/1972 Schneider ..... 358/305
3,990,763 A * 11/1976 Kress ..... 439/652
4,080,028 A * 3/1978 Gilbert ..... 439/62
4,131,805 A * 12/1978 Austin et al. ..... 307/147
4,250,858 A * 2/1981 Jeenicke et al. ..... 123/406.61
4,588,187 A * 5/1986 Dell ..... 463/47
4,726,790 A * 2/1988 Hadjis ..... 439/620.15
5,026,293 A * 6/1991 Wilson ..... 439/76.1
5,132,871 A * 7/1992 Densham et al. ..... 361/679.31
5,217,394 A * 6/1993 Ho ..... 439/620.21
5,383,795 A * 1/1995 Falossi et al. ..... 439/362
5,411,416 A * 5/1995 Balon et al. ..... 439/639
RE35,231 E * 5/1996 Wilson ..... 439/76.1
5,562,463 A * 10/1996 Tan ..... 439/76.1
5,719,933 A * 2/1998 Welch ..... 379/397
5,800,218 A * 9/1998 Abucewicz ..... 439/76.1
5,818,426 A * 10/1998 Tierney et al. ..... 345/161
5,823,796 A * 10/1998 Bethurum ..... 439/76.1
5,895,297 A * 4/1999 Ivan ..... 439/712
5,947,771 A * 9/1999 Bethurum ..... 439/668

(Continued)

OTHER PUBLICATIONS

5 Reasons Why Rauland Responder makes your job easier, copyright 1999, Rauland-Borg Corporation, Mount Prospect, IL, USA.

(Continued)

*Primary Examiner* — Tulsidas C Patel
*Assistant Examiner* — Vladimir Imas
(74) *Attorney, Agent, or Firm* — Smith Moore Leatherwood LLP

(57) ABSTRACT

A method of installing an adapter, a kit including an adapter, and an adapter are disclosed. The adapter includes a first connector, a second connector, and a component adapted for facilitating the second connector to electrical communicate with a portion of a plurality of pins or sockets of the first connector in a predetermined pinout. The first connector has a first plurality of pins or sockets. The second connector has a plug and a socket. Each of the plug and socket has a second plurality of pins or sockets. One of the plug and the socket of the second connector is adapted to mechanically communicate with a first portion of a third plurality of electrical conductors to facilitate electrical communication. The other of the plug and the socket of the second connector is adapted to electrically communicate with a first portion of the first plurality of pins or sockets of the first connector.

44 Claims, 8 Drawing Sheets

U.S. PATENT DOCUMENTS

| | | | | |
|---|---|---|---|---|
| 5,982,614 | A * | 11/1999 | Reid | 361/679.45 |
| 6,098,127 | A * | 8/2000 | Kwang | 710/62 |
| 6,146,153 | A * | 11/2000 | Koradia et al. | 439/76.1 |
| 6,152,778 | A * | 11/2000 | Dalton | 439/638 |
| 6,176,743 | B1 * | 1/2001 | Kuo | 439/638 |
| 6,625,881 | B2 | 9/2003 | Ammar et al. | |
| 6,943,527 | B2 * | 9/2005 | Liu et al. | 320/107 |
| 6,945,821 | B2 | 9/2005 | Stoner et al. | |
| 6,948,949 | B1 * | 9/2005 | Schwartz et al. | 439/76.1 |
| 6,984,132 | B1 * | 1/2006 | Spalding et al. | 439/76.1 |
| 7,238,046 | B2 | 7/2007 | Chou et al. | |
| 7,399,205 | B2 | 7/2008 | McNeely et al. | |
| 7,491,086 | B2 * | 2/2009 | Aoki | 439/541.5 |
| 2001/0053624 | A1 | 12/2001 | Medina et al. | |
| 2002/0193015 | A1 | 12/2002 | Milan | |
| 2003/0194910 | A1 | 10/2003 | Stoner et al. | |
| 2003/0216069 | A1 | 11/2003 | Huang | |
| 2009/0174991 | A1 * | 7/2009 | Mahdavi | 361/679.02 |

OTHER PUBLICATIONS

A Prescription For Efficient Building Management, copyright 2006, pp. 1-18, Merten GmbH & Co. KG, Gummersbach, Germany.
Adapter, Wikipedia Online Encyclopedia entry, copyright 2010.
Advanced Tone-Visual Nurse Call, Provider® 620, date unknown, Jeron Electronic Systems, Inc., Chicago, IL, USA.
AMP Terminating Head 58063-2 for Amplite HDE-20 Connectors, copyright 1988, AMP Incorporated.
B&B Electronics Manufacturing Company, Glossary of Terms, copyright 2010, pp. 1-33.
B&B Electronics, Complete Industrial and Commercial Solutions, date unknown, pp. 134-142.
Bed Cables, web page, copyright 2010, Rauland-Borg Corporation, Mount Prospect, IL, USA.
Carlton-Bates, web site, copyright 2010, http://www.carlton-bates.com/index.shtml, Carlton-Bates of Little Rock, AR, USA.
Crest Healthcare Supply, Search Results for 37-pin, copyright 2010.
D Accessories, Suitable For All McMurdo D Sub-miniature Connectors, date unknown, McMurdo Connectors, Portsmouth, England.
Digi-Key Corporation, Tools, Surepunch 66/110 IDC Term—4571, web site, copyright 2010, http://parts.digikey.sg/1/1/250556-tool-surepunch-66-110-idc-term-4571.html.
Division 16 Electrical, Section 16750—Nurse Call Systems, outline, date unknown.
D-subminiature, Wikipedia Online Encyclopedia entry, copyright 2010.
EDA Inc., 8LA /B/C/D Ordering Information, copyright 1986.
Elderwood Assisted Living At Crestwood, Progress Print, copyright 2010, Fontanese Folts Aubrecht Ernst, Architects, Orchard Park, NY, USA.
Electrical Symbols, chart, date unknown.
Electro Sonic parts manual, copyright 2006, Electro Sonic, www.e-sonic.com.
Electronic connector, Wikipedia Online Encyclopedia entry, copyright 2010.
EM-900 WA User Manual, copyright 2004, pp. 1-19, United Security Products, Inc.
GPCS, Patient Control Station, date unknown, Cooper Controls, www.coopercontrol.com, Peachtree City, GA, USA.
Hill Rom Navi-Care/Nurse Call, web site, copyright 2010, http://www.hill rom.com/usa/NaviCare_NurseCall.htm, Hill-Rom Corporate Offices, Batesville, IN, USA.
Hill-Rom TotalCare® Connect Bed and TotalCare® Bed, Options and Accessories, copyright 2008, 2009, Hill-Rom Services, Inc.
Hill-Rom VersaCare® TC Bed, "It's Just Right," copyright 2008, Hill-Rom Services, Inc.
Hill-Rom web site, copyright 2010, http://www.hill rom.com/usa/index.asp, Hill Rom Corporate Offices, Batesville, IN, USA.
Hill-Rom® TotalCare® Connect Bed, "It's an easy choice," web site, copyright 2010, http://www.hill-rom.com/usa/PDF/CTG271.pdf, Hill Rom Corporate Offices, Batesville, IN, USA.
Hospital Beds, web site, copyright 2010, http://www.stryker.com/en-us/products/PatientHandlingEMSandEvacuationEquipment/Beds/index.htm.
HwB Hardware Book, copyright 2010, web site, www.hardwarebook.info/Main_Page.
IDC Cable, Headers & Connectors, Electus Distribution Reference Data Sheet: IDCCONNE.PDF, copyright 2004, Electus Distribution.
Instruction Manual, Nursing Bed DALI II 24 Volt, copyright 2008, pp. 1-72, Burmeier GmbH & Co. KG, Lage/Lippe, Germany.
Insulation Displacement Connectors (IDCs), copyright 1999, 3M Electronics Division, Austin, TX, USA.
Insulation Displacement Connectors, date unknown, McMurdo Connectors, Portsmouth, England.
Insulation-displacement connector, Wikipedia Online Encyclopedia entry, copyright 2010.
InTouch Critical Care Bed, web site, copyright 2010, http://www.stryker.com/stellent/groups/jsp/documents/adacct/056403.pdf.
IR-155B Single Patient Station, copyright 2009, Lee Dan Communications, Inc., Hauppauge, NY, USA.
IR-318B Single Patient Station, copyright 2009, Lee Dan Communications, Inc., Hauppauge, NY, USA.
Janos Legrady, "A New Type of Very High Reliability Torsion IDC Which Can Accept A Large Range of Wire Gauges," date unknown, Zierick Manufacturing Corporation, Mount Kisco, NY, USA.
Jeron Electronic Systems, web site, copyright 2010, http://www.jeron.com/, Jeron Electronic Systems, Inc., Chicago, IL, USA.
KeepSafe Deluxe, Cat. 8374, Cat. 8374NP, Instruction Manual, copyright 2008, pp. 1-28, Posey Company, Arcadia, CA, USA.
Modular connector, Wikipedia Online Encyclopedia entry, copyright 2010.
NaviCare Patient Safety, web site, copyright 2010, Hill-Rom Corporate Offices, Batesville, IN, USA.
Newark of Chicago, Part No. 26M7826, web site, copyright 2010, http://www.newark.com/multicomp/8lcm037s-304b-xx/socket-d-pcb-r-a-37way/dp/26M7826?Ntt=26M7826, Newark of Chicago, IL, USA.
Ohio® Infant Warmer Systems, All Models, Operation and Maintenance Manual, copyright 1994, Ohmedia Medical.
Patient Bed Service Walls 10 25 13, Spec Data, copyright 2009, Reed Construction Data®.
Pinout, Wikipedia Online Encyclopedia entry, copyright 2010.
Pinouts.ru 7×47 pin (IEC917 and IEC1076-4-101) connector diagram and applications, web site, copyright 2010, http://pinouts.ru/connector/.
Posey Company FAQ No. 45, Fall Monitors Frequency Asked Questions, copyrigh 2005, www.posey.com, Posey Company, Arcadia, CA, USA.
Printed Circuit Board, Wikipedia Online Encyclopedia entry, copyright 2010.
Provider® 680 Application Brief, Centralized Code Blue for Optimal Response Times, date unknown, Jeron Electronic Systems, Inc., Chicago, IL, USA.
Provider® 680 Application Brief, Medical Device Alarms through Nurse Call Improve Patient Safety, date unknown, Jeron Electronic Systems, Inc., Chicago, IL, USA.
Provider® 680 Nurse Call System, Comprehensive Staff and Patient Communications: Emphasizing Patient-Centered Care, date unknown, Jeron Electronic Systems, Inc., Chicago, IL, USA.
Punch block, Wikipedia Online Encyclopedia entry, copyright 2010.
Punch down tool, Wikipedia Online Encyclopedia entry, copyright 2010.
Rauland web site, copyright 2010, http://www.rauland.com/index.cfm, Rauland-Borg Corporation, Mount Prospect, IL, USA.
Responder 5 Pillow Speakers, web page, copyright 2010, www.rauland.com/Pillow_Speakers.cfm, Rauland-Borg Corporation, Mount Prospect, IL, USA.
Responder: The System That Fits Your Needs, web page, copyright 2010, www.rauland.com/Healthcare_Products.cfm, Rauland-Borg Corporation, Mount Prospect, IL, USA.
Responder® Acessories, Customize Responder to Your Patient's Specific Calling Requirements With Our Wide Range of System Accessories, web page, copyright 2010, Rauland-Borg Corporation, Mount Prospect, IL, USA.

Robert D. Malucci, Insulation Displacing Connector Technology, copyright 2010, Molex Incorporated, Lisle, IL, USA.
Section 27 52 23 Nurse Call and Code Blue Systems, copyright 2010, pp. 1-86.
SL Series 110 Jack Termination Tool, Tool Kit, 1725150-1, date unknown, Tyco Electronics.
Stryker S3 Patriot Series Med/Surg Bed, copyright 2008, Stryker, Portage, MI, USA.
Stryker S3™ Signature Series, copyright 2008, Stryker, Portage, MI, USA.
Tek-CARE 500 Wireless Emergency Call System, web page, copyright 2010, www.tektone.com/tekcare500.htm.
TekTone CM800 Emegency Call System, web page, copyright 2010, http://www.tektone.com/cm800.htm.
TekTone Condensed Catalog Section D—Emergency Call Systems, copyright 2008, TekTone® Sound & Signal Mfg., Inc.
TekTone DS100 Door Sentry & Emergency Alarm System, Specification Sheets Submittal Package, copyright 2008, TekTone® Sound & Signal Mfg., Inc.
TekTone DS100 Door Sentry & Emergency Alarm System, web page, copyright 2010, http://www.tektone.com/ds100.htm.
TekTone IR150SS, IR150SS/S Remote Call Stations Specification Sheet, copyright 2010, TekTone® Sound & Signal Mfg., Inc.
TekTone NC15OR Master Station Panel Specification Sheet, Revision 9, copyright 2010, TekTone® Sound & Signal Mfg., Inc.
TekTone NC150R Master Station Panel Specification Sheet, Revision 8, copyright 2008, TekTone® Sound & Signal Mfg., Inc.
TekTone PK124K Battery Backup Kit, Specification Sheets Submittal Package, copyright 2008, TekTone® Sound & Signal Mfg., Inc.
TekTone PK151A Annunciator Control Unit Specifciation Sheet, copyright 2010, TekTone® Sound & Signal Mfg., Inc.
TekTone SI002 Area of Rescue Assistance Sign Specification Sheet, copyright 2010, TekTone® Sound & Signal Mfg., Inc.
TekTone SI003 Directional Arrow Sign Specification Sheet, copyright 2010, TekTone® Sound & Signal Mfg., Inc.
TekTone SS102A, SS105B, SS106 Transformers, PO001 Electric Door Opener Specification Sheet, copyright 2010, TekTone® Sound & Signal Mfg., Inc.
TekTone Tek-SAFE™ Area of Rescue Assistance System, Specifciation Sheets Submittal Package, copyright 2009, TekTone® Sound & Signal Mfg., Inc.
TekTone® Sound & Signal, web site, copyright 2010, http://www.tektone.com/index.htm, TekTone® Sound & Signal Mfg., Inc., Franklin, NC, USA.
Tyco Electronics Connectors, copyright 2010, Carlton-Bates Company, www.carlton-bates.com.
Tyco Electronics, IDC Connectors Product Line Information, copyright 2010.
Welch Community Hospital New Nurse Call System, copyright 2007, SimplexGrinnel, Charleston, WV, USA.

* cited by examiner

METHOD, KIT, AND AN ASSOCIATED ADAPTOR, USABLE WITH A HOSPITAL BED

This is a continuation-in-part of application Ser. No. 12/459,484, filed Jul. 2, 2009, now abandoned and the entirety of the foregoing application is incorporated herein by reference.

Aspects of embodiments and embodiments of the present invention are directed to one or more of a method of installing an adapter, a kit including an adapter, and an adapter. The adapter includes a first connector, a second connector, and a component adapted for facilitating the second connector to electrical communicate with a portion of a plurality of pins or sockets of the first connector in a first predetermined pinout.

BACKGROUND OF INVENTION

Often associated with a hospital bed there is preselected equipment in electrical communication with a nurse call station. The preselected equipment can include controls to enable, for example, a patient, nurse, or orderly to adjust the bed, operate room lighting, and select entertainment as well as a speaker for entertainment and nurse call system intercom audio. A plurality of electrical conductors, which can be in the form of one or more cables, facilitate electrical communication of the preselected equipment and the nurse call station through a connector. The connector, which has a plurality of pins or sockets, is typically mounted on a lower portion of a wall at about shin level while the nurse call station is typically mounted on an upper portion of a wall at about eye level. Through the normal movement of a hospital bed, that can involve removing and replacing a complement to the connecter, the connecter can become worn. Sometimes when the movement of a hospital bed is done in haste without removing the complement to the connecter from the connecter, the wear of the connecter is accelerated, or the connecter is damaged. Whether worn or damaged, the connecter is eventually replaced by skilled personal typically taking several hours. During those hours, the skilled personal records the connection sequenced of the plurality of electrical conductors to the nurse call station, disconnects the plurality of electrical conductors from the nurse call station, removes the worn or damaged connecter and its associated plurality of electrical conductors, provides a new connecter and its associated plurality of electrical conductors, fishes the associated plurality of electrical conductors to the nurse call station, reconnects the associated plurality of electrical conductors to the nurse call station in the recorded connection sequenced, and replaces the connector and the nurse call station.

BRIEF SUMMARY OF INVENTION

The problems of skilled personal requiring several hours to replace and/or unskilled and semi-skilled personal being incapable of replacing a connector having a plurality of pins or sockets electrically communicating through a plurality of electrical conductors in a predetermined pinout to facilitate electrical communication among preselected equipment associated with a preselected hospital bed (e.g., Stryker Medical, Portage, Mich., USA: see e.g., http://www.stryker.com/en-us/products/PatientHandlingEMSandEvacuationEquipment/Beds/index.htm and http://www.stryker.com/stellent/groups/jsp/documents/adacct/056403.pdf as well as Hill-Rom Corporate Offices, Batesville, Ind., USA: http://www.hill-rom.com/usa/index.asp and http://www.hill-rom.com/usa/PDF/CTG271.pdf) and a preselected nurse station (see e.g., Rauland-Borg Corporation, Mount Prospect, Ill., USA: http://www.rauland.com/index.cfm; Jeron Electronic Systems, Inc., Chicago, Ill., USA: http://www.jeron.com/; TekTone® Sound & Signal Mfg., Inc., Franklin, N.C., USA: http://www.tektone.com/index.htm; and Hill-Rom Corporate Offices, Batesville, Ind., USA: http://www.hill-rom.com/usa/NaviCare_Nurse-Call.htm that are merely four out of a possibility of about 25) are solved by any one of a method of installing an adapter, a kit including an adapter, and an adapter. The adapter includes a first connector, a second connector, and a component adapted for facilitating the second connector to electrical communicate with a portion of a plurality of pins or sockets of the first connector in a first predetermined pinout.

Some aspects of embodiments and embodiments of the present invention meet these and other needs by providing, without limitation, an adapter 10 including a first connector 12, a second connector 14, and a component 16 adapted to facilitate electrical communication between the second connector 14 and a portion 18 of a plurality of the pins or sockets 22 of the first connector 12 in a first predetermined pinout. As noted, the first connector 12 has a first plurality of pins or sockets 22. The second connector 14 has a plug 24 and a socket 26. Each of the plug 24 and socket 26 has a second plurality of pins or sockets 30. One of the plug 24 and the socket 26 of the second connector 14 is adapted to mechanically communicate with a first portion 17 of a third plurality of electrical conductors 32 to facilitate electrical communication. The other of the plug 24 and the socket 26 of the second connector 14 is adapted to electrically communicate with a first portion 18 of the first plurality of pins or sockets 22 of the first connector 12. The component 16 includes a plurality of conductors 28 adapted for facilitating the other of the plug 24 and the socket 26 of the second connector 14 to electrically communicate with the first portion 18 of the first plurality of pins or sockets 22 of the first connector 12 in a first predetermined pinout.

Other aspects of embodiments and embodiments of the present invention meet these and other needs by providing, without limitation, a kit 50 including an adapter 10 and, optionally, a tool 48. The adapter 10 includes a first connector 12, a second connector 14, and a component 16 adapted to facilitate electrical communication between the second connector 14 and a portion 18 of a plurality of the pins or sockets 22 of the first connector 12 in a first predetermined pinout. As noted, the first connector 12 as a first plurality of pins or sockets 22. The second connector 14 has a plug 24 and a socket 26. Each of the plug 24 and socket 26 has a second plurality of pins or sockets 30. One of the plug 24 and the socket 26 of the second connector 14 is adapted to mechanically communicate with a first portion 17 of a third plurality of electrical conductors 32 to facilitate electrical communication. The other of the plug 24 and the socket 26 of the second connector 14 is adapted to electrically communicate with a first portion 18 of the first plurality of pins or sockets 22 of the first connector 12. The component 16 includes a plurality of conductors 28 adapted for facilitating the other of the plug 24 and the socket 26 of the second connector 14 to electrically communicate with the first portion 18 of the first plurality of pins or sockets 22 of the first connector 12 in a first predetermined pinout. The tool 48 is adapted to facilitate a mechanical communication of a third plurality of electrical conductors 32 to one of a plug 24 and a socket 26 of a second connector 14 to facilitate electrical communication of the third plurality of electrical conductors 32 with a third portion of a first plurality of pins or sockets 22 of a first connector 12.

Still other aspects of embodiments and embodiments of the present invention meet these and other needs by providing, without limitation, a method for replacing a connector adapted to facilitate the electrical communication among preselected equipment 34 associated with a preselected hospital bed 36 and a preselected nurse station. The method includes providing an adapter 10 including a first connector 12, a second connector 14, and a component 16 adapted to facilitate electrical communication between the second connector 14 and a first portion 18 of a plurality of the pins or sockets 22 of the first connector 12 in a first predetermined pinout and communicating the third plurality of electrical conductors 32 to the one of the plug 24 and the socket 26 of the second connector 14. As noted, the first connector 12 as a first plurality of pins or sockets 22. The second connector 14 has a plug 24 and a socket 26. Each of the plug 24 and socket 26 has a second plurality of pins or sockets 30. One of the plug 24 and the socket 26 of the second connector 14 is adapted to mechanically communicate with a first portion 17 of a third plurality of electrical conductors 32 to facilitate electrical communication. The other of the plug 24 and the socket 26 of the second connector 14 is adapted to electrically communicate with a first portion 18 of the first plurality of pins or sockets 22 of the first connector 12. The component 16 includes a plurality of conductors 28 adapted for facilitating the other of the plug 24 and the socket 26 of the second connector 14 to electrically communicate with the first portion 18 of the first plurality of pins or sockets 22 of the first connector 12 in a first predetermined pinout. The tool 48 is adapted to facilitate a mechanical communication of a third plurality of electrical conductors 32 to one of a plug 24 and a socket 26 of a second connector 14 to facilitate electrical communication of the third plurality of electrical conductors 32 with a first portion of a first plurality of pins or sockets 22 of a first connector 12.

Accordingly, some aspects of embodiments and embodiments of the present invention provide an adapter 10 further might include guidance indicia 20 adapted to provide guidance for the mechanical communication of the third plurality of electrical conductors 32 to the one of the plug 24 and the socket 26 of the second connector 14 to facilitate electrical communication of the third plurality of electrical conductors 32 with the first portion 18 of the first plurality of pins or sockets 22 of the first connector 12 in the predetermined pinout to facilitate electrical communication among preselected equipment 34 associated with a preselected hospital bed 36 and a preselected nurse call station 40.

Some other aspects of embodiments and embodiments of the present invention provide further including a third connector 14' or even a fourth connector 14". The third connector 14' has a plug 24' and a socket 26'. Each of the plug 24' and socket 26' has a second plurality of pins or sockets 30'. One of the plug 24' and socket 26' of the third connector 14' is adapted to mechanically communicate with a second portion 17' of a third plurality of electrical conductors 32 to facilitate electrical communication. The other of the plug 24' and the socket 26' of the third connector 14' is adapted to electrically communicate with a second portion 18' of the first plurality of pins or sockets 22 of the first connector 12. The component 16 includes a plurality of conductors 28 adapted for facilitating the other of the plug 24 and the socket 26 of the third connector 14' to electrically communicate with the second portion 18' of the first plurality of pins or sockets 22 of the first connector 12 in a first predetermined pinout. The fourth connector 14" has a plug 24" and a socket 26". Each of the plug 24'v and socket 26" has a third plurality of pins or sockets 30". One of the plug 24" and socket 26" of the fourth connector 14' is adapted to mechanically communicate with a third portion 17" of a third plurality of electrical conductors 32 to facilitate electrical communication. The other of the plug 24' and the socket 26' of the fourth connector 14' is adapted to electrically communicate with a third portion 18" of the first plurality of pins or sockets 22 of the first connector 12. Again, the component 16 includes a third plurality of conductors 28 adapted for facilitating the other of the plug 24 and the socket 26 of the fourth connector 14" to electrically communicate with the third portion 18" of the first plurality of pins or sockets 22 of the first connector 12 in a first predetermined pinout.

Still yet other aspects of embodiments and embodiments of the present invention provide that the first connector 12 be a D-subminiature connector. As another example, aspects of embodiments and embodiments of the present invention, any one of the second connector 14, the third connector 14', the fourth connector 14", or any combinations thereof, includes an insulation-displacement connector (IDC connector) or insulation-piercing connectors (IPC connector).

As yet another example, aspects of embodiments and embodiments, the component 16 comprising a plurality of conductors comprises a printed circuit board (PCB).

As still yet another example, aspects of embodiments and embodiments, the indicia 20 adapted to provide guidance comprises a cross-reference between the pins or sockets the second connector 14 and a color of the third plurality of electrical conductors 32.

As even still yet another example, aspects of embodiments and embodiments, the third plurality of electrical conductors 32 comprise a plurality of cables and the indicia 20 adapted to provide guidance comprises a cross-reference between a color of the electrical conductors of each cable of the plurality of cables and the pins or sockets each of the second 14, third 14', and fourth 14" connectors.

Numerous other aspects of embodiments, embodiments, features, and advantages of the present invention will appear from the following detailed description and the accompanying drawings. In the description and/or the accompanying drawings, reference is made to exemplary aspects of embodiments and/or embodiments of the invention which can be applied individually or combined in any way with each other. Such aspects of embodiments and/or embodiments do not represent the full scope of the invention. Reference should therefore be made to the claims herein for interpreting the full scope of the invention. In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Also in the interest of brevity and conciseness, it is to be understood that such terms as "is," "are," "includes," "having," "comprises," and the like are words of convenience and are not to be construed as limiting terms and yet may encompass the terms "comprises," "consists essentially of," "consists of," and the like as is appropriate.

These and other aspects, advantages, and salient features of the present invention will become apparent from the following detailed description, the accompanying drawings, and the appended claims.

BRIEF DESCRIPTION OF DRAWINGS

The drawings referenced herein form a part of the specification. Features shown in the drawings are meant to be illustrative of some, but not all, embodiments of the invention, unless otherwise explicitly indicated, and implications to the contrary are otherwise not to be made. Although like reference numerals correspond to similar, though not necessarily identical, components and/or features in the drawings, for the sake of brevity, reference numerals or features having a previously described function may not necessarily be described in connection with other drawings in which such components and/or features appear.

DETAILED DESCRIPTION

In the following detailed description of exemplary aspects of embodiments and embodiments of the invention, reference is made to the accompanying drawings that form a part hereof, and in which are shown by way of illustration specific aspects of embodiments and embodiments in which the invention may be practiced. While these aspects of embodiments and embodiments are described in sufficient detail to enable those skilled in the art to practice the invention, it will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure. Specifically, other aspects of embodiments and embodiments may be utilized, logical changes (e.g., without limitation, any one or more of chemical, compositional, materials, electrical, electrochemical, electromechanical, electro-optical, mechanical, optical, physical, physiochemical, . . . and the like) and other changes may be made without departing from the spirit or scope of the present invention. Accordingly, the following detailed description is not to be taken in a limiting sense, and the scope of aspects of embodiments and embodiments of the present invention are defined by the appended claims. It is also understood that terms such as "top," "bottom," "outward," "inward," and the like are words of convenience and are not to be construed as limiting terms.

Figure 1:
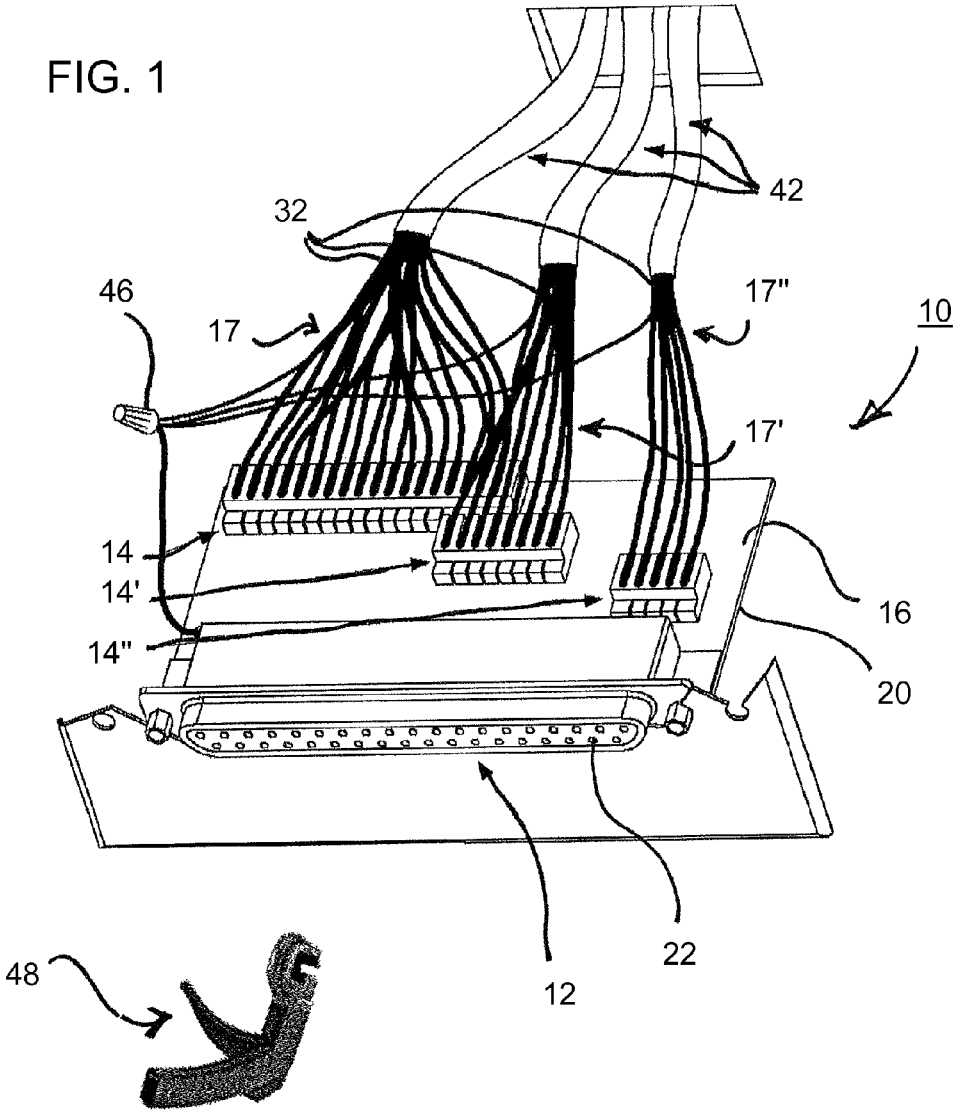
FIG. 1 is a schematic illustrating an adapter constructed according to aspects of embodiments and/or embodiments of the present invention.
Figure 2:
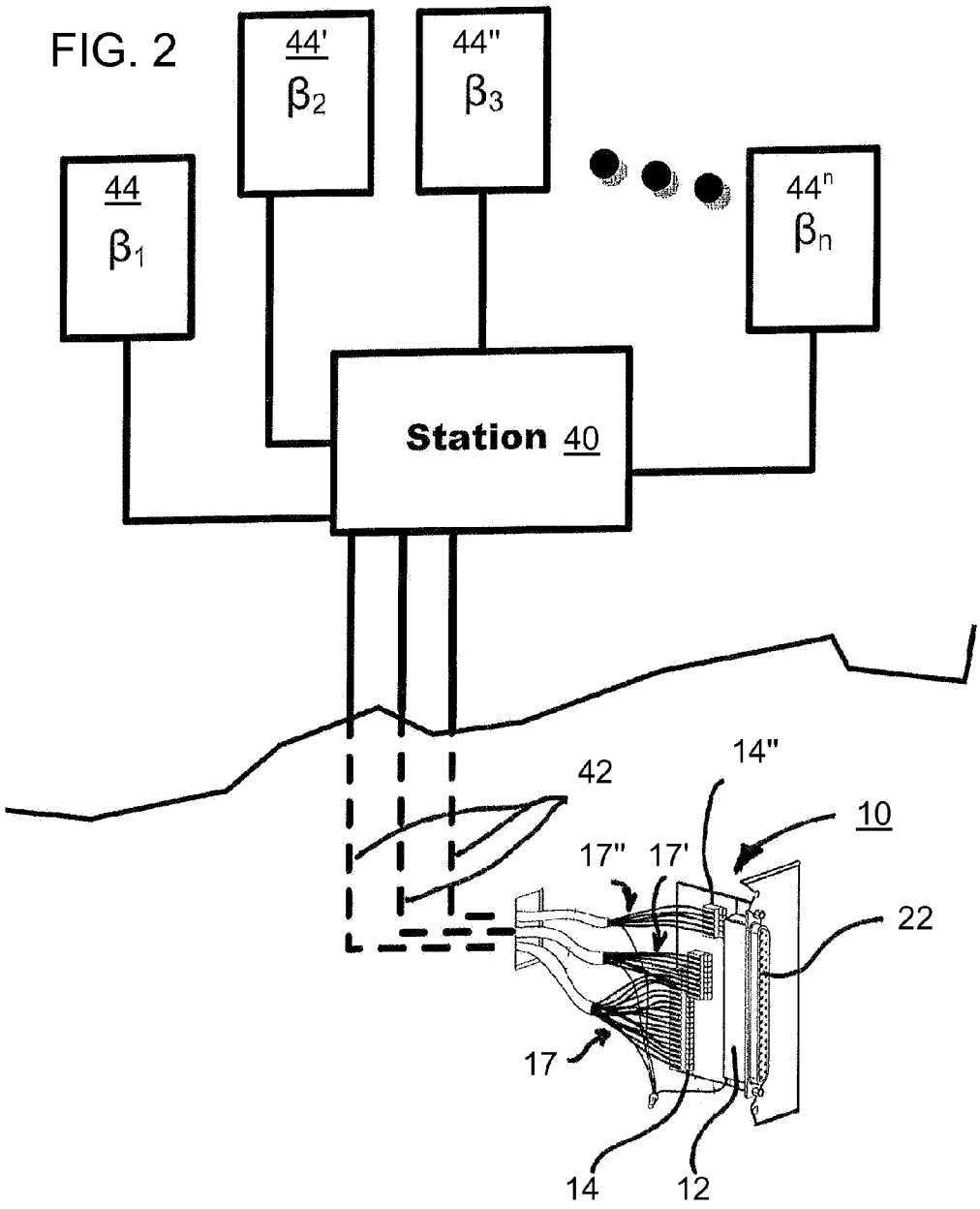
FIG. 2 is a schematic illustrating a use of the adapter of FIG. 1 to electrically communicate with a station electrically communicating with a plurality of peripherals according to aspects of embodiments and/or embodiments of the present invention.
Figure 3:
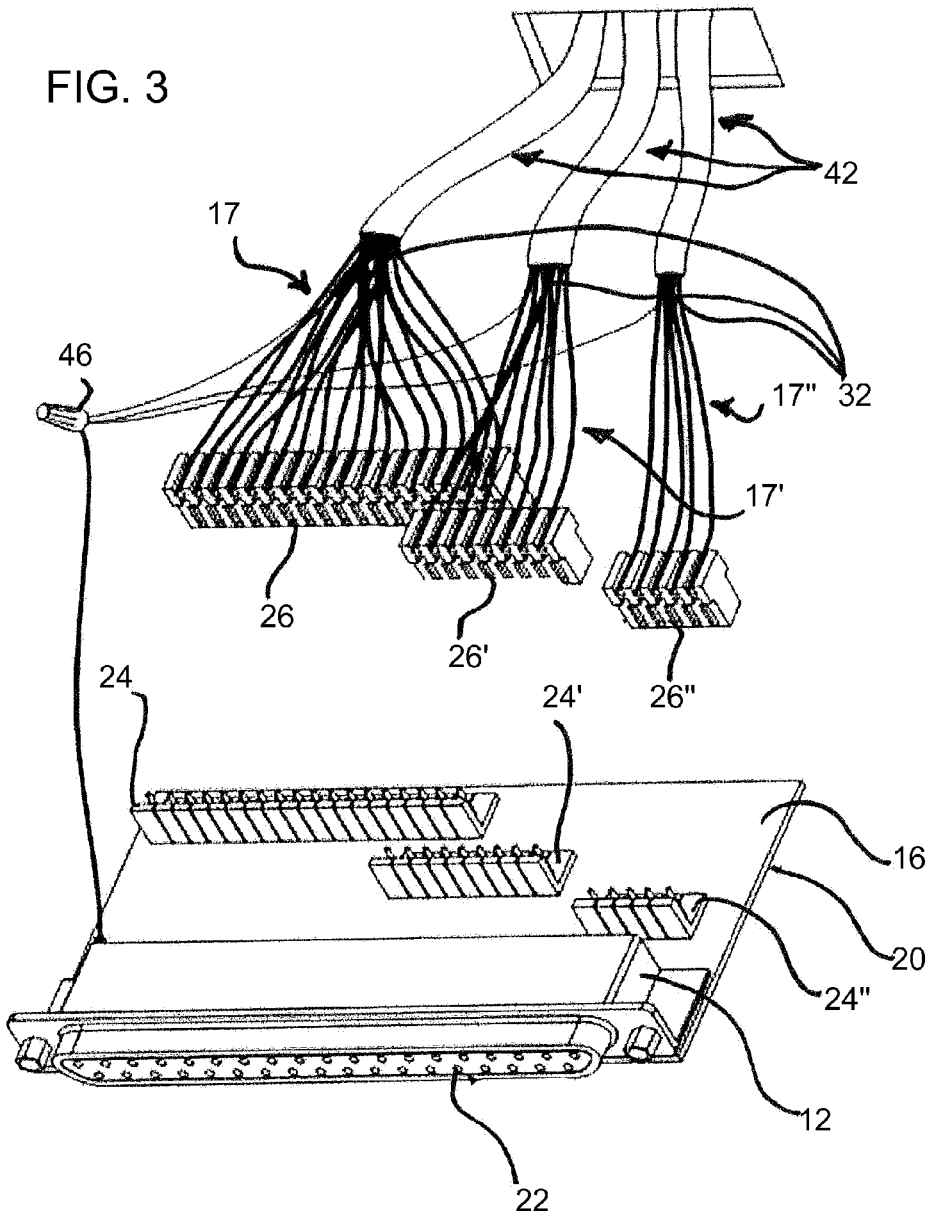
FIG. 3 is a schematic illustrating details of the adapter of FIG. 1 according to aspects of embodiments and/or embodiments of the present invention.
Figure 6:
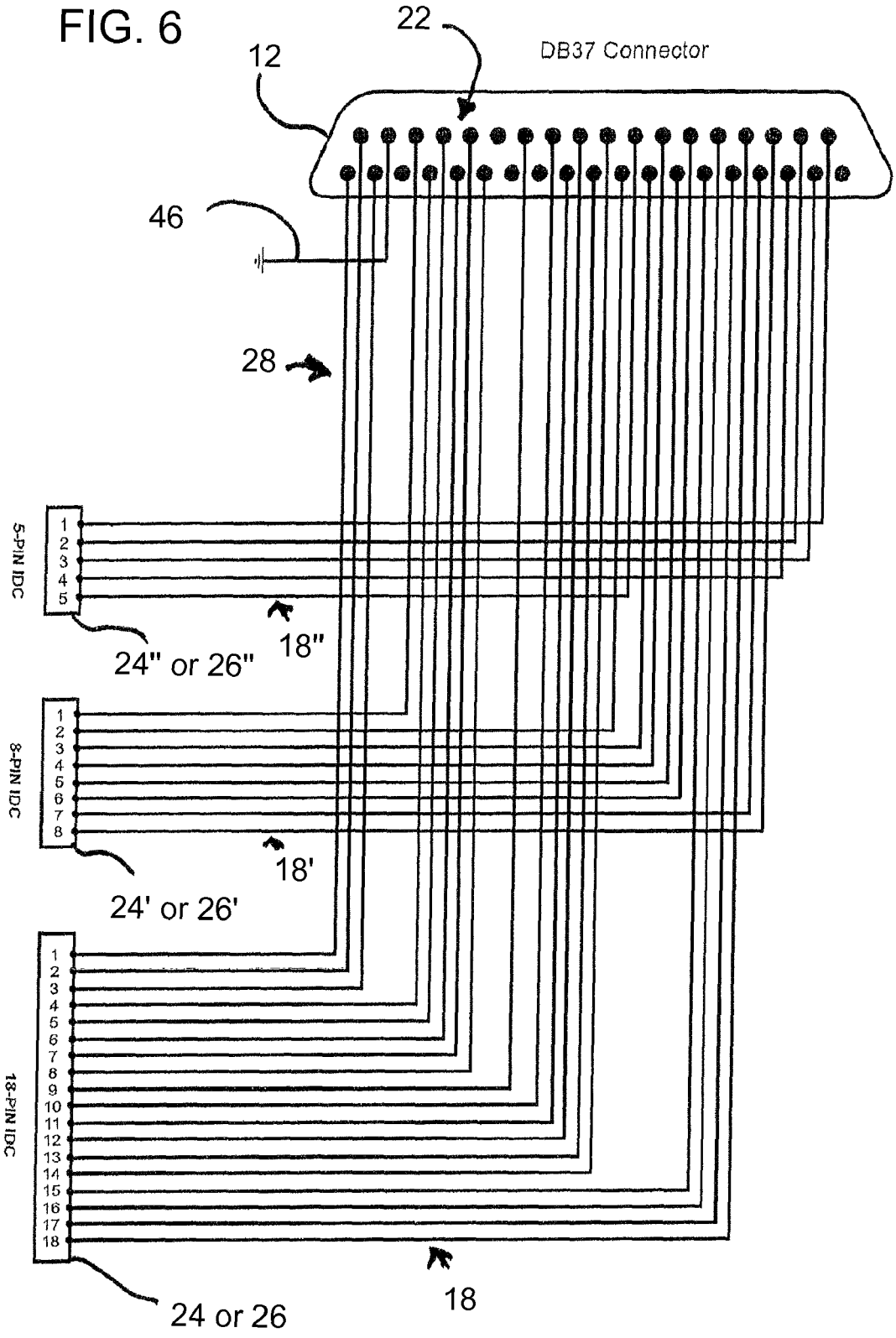
FIG. 6 is a schematic illustrating a predetermined pinout for the adapter of FIG. 1 according to aspects of embodiments and/or embodiments of the present invention.
Figure 7:
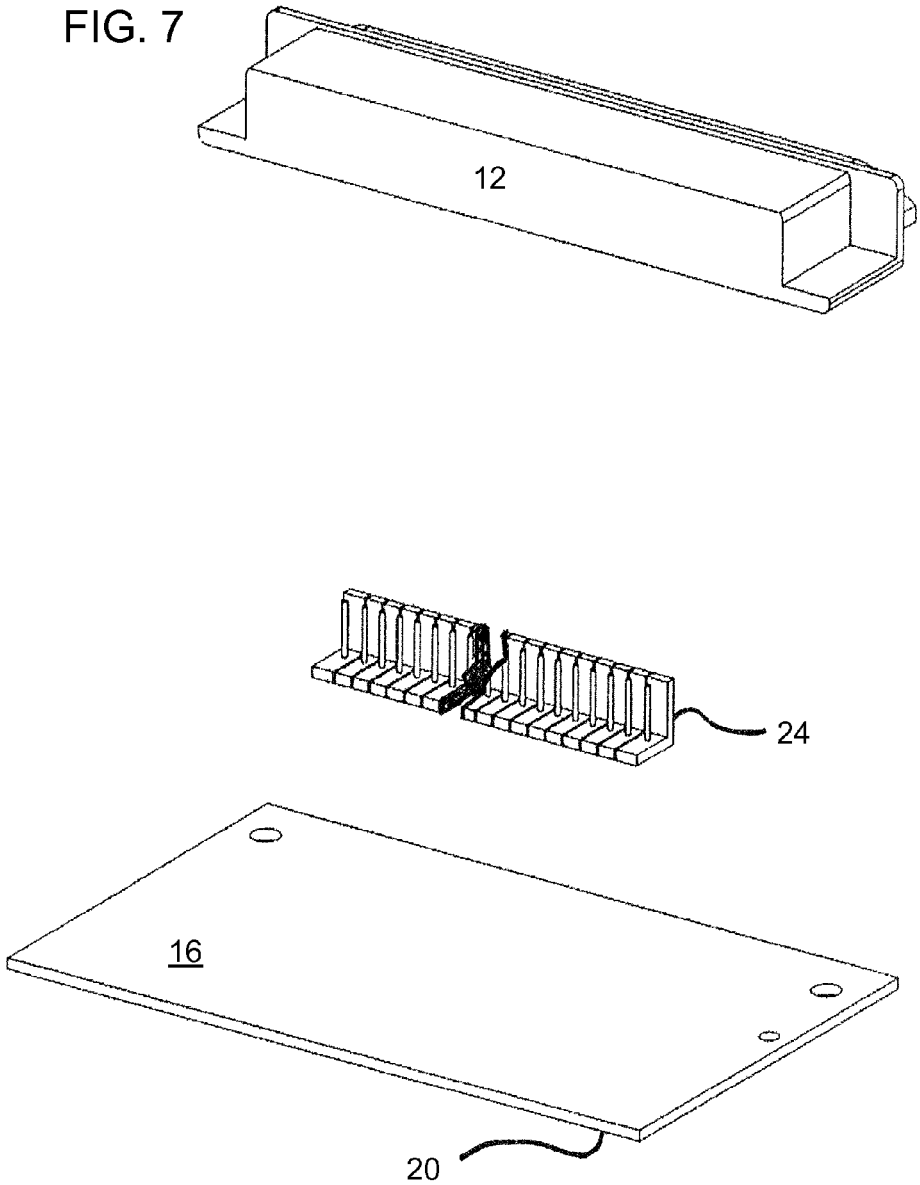
FIG. 7 is a schematic illustrating an exploded view of an alternative adapter according to aspects of embodiments and/or embodiments of the present invention.
Figure 8:
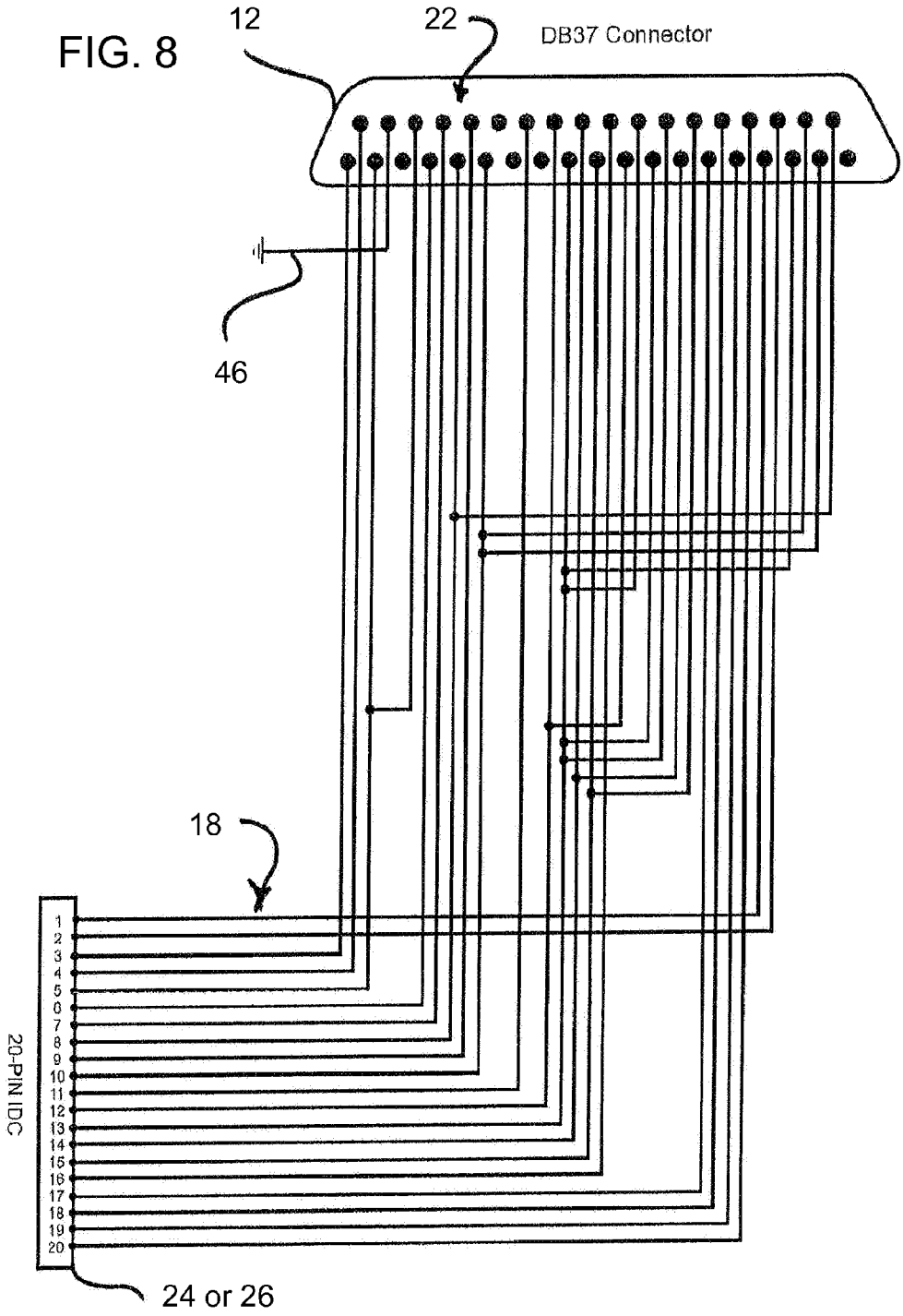
FIG. 8 is a schematic illustrating a predetermined pinout for the alternative adapter of FIG. 7 according to aspects of embodiments and/or embodiments of the present invention.

Referring now to the drawings in general and FIG. 1 and FIG. 2 in particular, a perspective views of an adapter 10 is shown. As shown in FIG. 1, FIG. 3, FIG. 6, and FIG. 8, adapter 10 includes a first connector 12, a second connector 14, and a component 16 adapted to facilitate electrical communication between the second connector 14 and a portion 18 (see FIG. 6 and FIG. 8) of a plurality of the pins or sockets 22 of the first connector 12 in a first predetermined pinout. As noted and can be seen in FIG. 1, FIG. 3, FIG. 6, and FIG. 8, the first connector 12 has a first plurality of pins or sockets 22. As can be seen in FIG. 3, the second connector 14 has a plug 24 and a socket 26. Each of the plug 24 and socket 26 has a second plurality of pins or sockets 30. As can be seen in FIG. 1 and FIG. 3, one of the plug 24 and the socket 26 of the second connector 14 is adapted to mechanically communicate with a first portion 17 of a third plurality of electrical conductors 32 to facilitate electrical communication. As can be seen in FIG. 6 and FIG. 8, the other of the plug 24 and the socket 26 of the second connector 14 is adapted to electrically communicate with a first portion 18 of the first plurality of pins or sockets 22 of the first connector 12. Also as can be seen in FIG. 6 and FIG. 8, the component 16 includes a plurality of conductors 28 adapted for facilitating the other of the plug 24 and the socket 26 of the second connector 14 to electrically communicate with the first portion 18 of the first plurality of pins or sockets 22 of the first connector 12 in a first predetermined pinout.

Other aspects of embodiments and embodiments of the present invention meet these and other needs by providing, without limitation, a kit 50 including an adapter 10 and, optionally, a tool 48. The adapter 10 includes a first connector 12, a second connector 14, and a component 16 adapted to facilitate electrical communication between the second connector 14 and a portion 18 of a plurality of the pins or sockets 22 of the first connector 12 in a first predetermined pinout. As noted, the first connector 12 has a first plurality of pins or sockets 22. The second connector 14 has a plug 24 and a socket 26. Each of the plug 24 and socket 26 has a second plurality of pins or sockets 30. One of the plug 24 and the socket 26 of the second connector 14 is adapted to mechanically communicate with a first portion 17 of a third plurality of electrical conductors 32 to facilitate electrical communication. The other of the plug 24 and the socket 26 of the second connector 14 is adapted to electrically communicate with a first portion 18 of the first plurality of pins or sockets 22 of the first connector 12. The component 16 includes a plurality of conductors 28 adapted for facilitating the other of the plug 24 and the socket 26 of the second connector 14 to electrically communicate with the first portion 18 of the first plurality of pins or sockets 22 of the first connector 12 in a first predetermined pinout. The tool 48 is adapted to facilitate a mechanical communication of a third plurality of electrical conductors 32 to one of a plug 24 and a socket 26 of a second connector 14 to facilitate electrical communication of the third plurality of electrical conductors 32 with a first portion of a first plurality of pins or sockets 22 of a first connector 12.

Still other aspects of embodiments and embodiments of the present invention meet these and other needs by providing, without limitation, a method for replacing a connector adapted to facilitate the electrical communication among preselected equipment 34 associated with a preselected hospital bed 36 and a preselected nurse station. The method includes providing an adapter 10 including a first connector 12, a second connector 14, and a component 16 adapted to facilitate electrical communication between the second connector 14 and a portion 18 of a plurality of the pins or sockets 22 of the first connector 12 in a first predetermined pinout and communicating the third plurality of electrical conductors 32 to the one of the plug 24 and the socket 26 of the second connector 14. As noted, the first connector 12 as a first plurality of pins or sockets 22. The second connector 14 has a plug 24 and a socket 26. Each of the plug 24 and socket 26 has a second plurality of pins or sockets 30. One of the plug 24 and the socket 26 of the second connector 14 is adapted to mechanically communicate with a first portion 17 of a third plurality of electrical conductors 32 to facilitate electrical communication. The other of the plug 24 and the socket 26 of the second connector 14 is adapted to electrically communicate with a first portion 18 of the first plurality of pins or sockets 22 of the first connector 12. The component 16 includes a plurality of conductors 28 adapted for facilitating the other of the plug 24 and the socket 26 of the second connector 14 to electrically communicate with the first portion 18 of the first plurality of pins or sockets 22 of the first connector 12 in a first predetermined pinout. The tool 48 is adapted to facilitate a mechanical communication of a third plurality of electrical conductors 32 to one of a plug 24 and a socket 26 of a second connector 14 to facilitate electrical communication of the third plurality of electrical conductors 32 with a first portion of a first plurality of pins or sockets 22 of a first connector 12.

| Example of Pinout Guidance Indicia 20 |
|---|
| Cable "A" |
| 1 - WHT (White) |
| 2 - GRN (Green) |
| 3 - BLK (Black) |
| 4 - RED (Red) |
| 5 - BRN (Brown) |
| Cable "B" |
| 1 - BLK (Black) |
| 2 - BRN (Brown) |
| 3 - BLU (Blue) |
| 4 - RED (red) |
| 5 - WHT (White) |
| 6 - ORG (Orange) |
| 7 - RED (Red) |
| 8 - GRN (Green) |
| Cable "C" |
| 1 - GRN (Green) |
| 2 - ORGBLK (Orange/Black) |
| 3 - RED (Red) |
| 4 - ORG (Orange) |
| 5 - BLK (Black) |
| 6 - RED/WHT (Red/White) |
| 7 - WHT/BLK (White/Black) |
| 8 - BLK/WHT (Black/White) |
| 9 - BLU/WHT (Blue/White) |
| 10 - ORG/RED (Orange/Red) |
| 11 - WHT/RED (White/Red) |
| 12 - WHT (White) |
| 13 - BLK/RED (Black/Red) |
| 14 - BLK (Black) |
| 15 - RED/BLK (Red/Black) |
| 16 - ORG/BLK (Orange/Black) |
| 17 - BLU/BLK (Blue/Black) |
| 18 - GRN/WHT (Green/White) |

Figure 4:
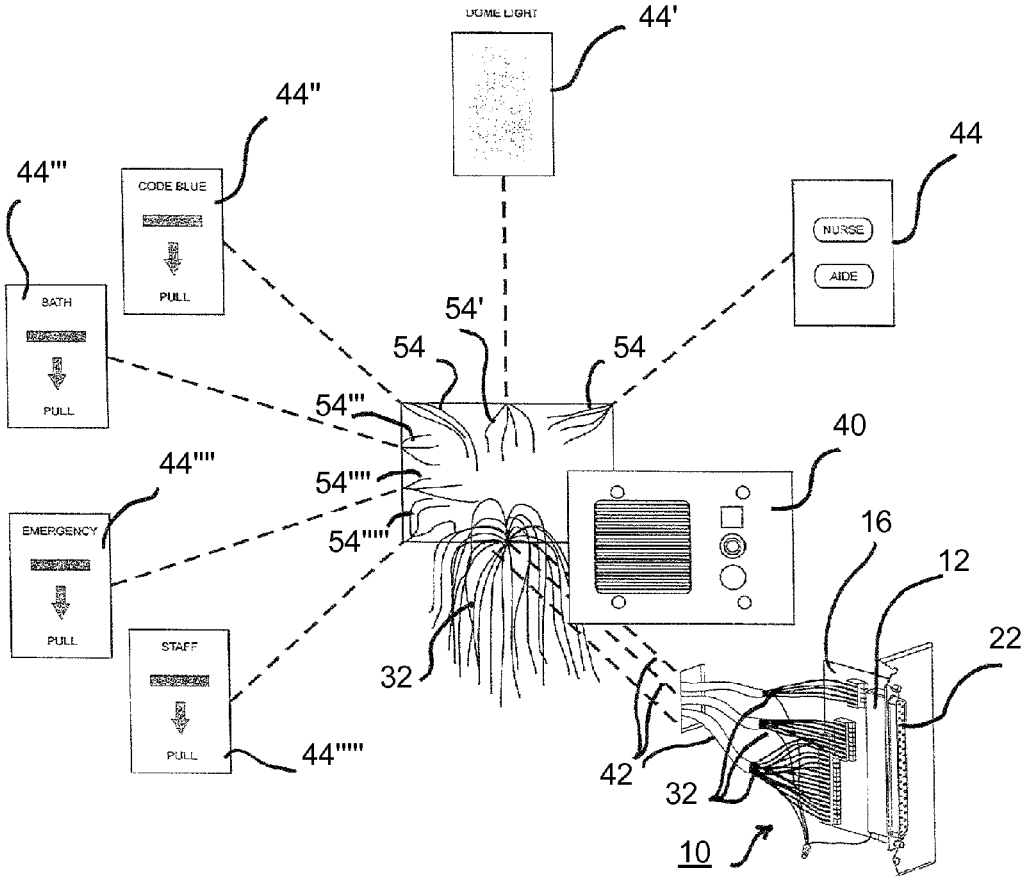
FIG. 4 is a schematic illustrating a use of the adapter of FIG. 1 to electrically communicate with a nurse call station electrically communicating with a plurality of hospital peripherals according to aspects of embodiments and/or embodiments of the present invention.
Figure 5:
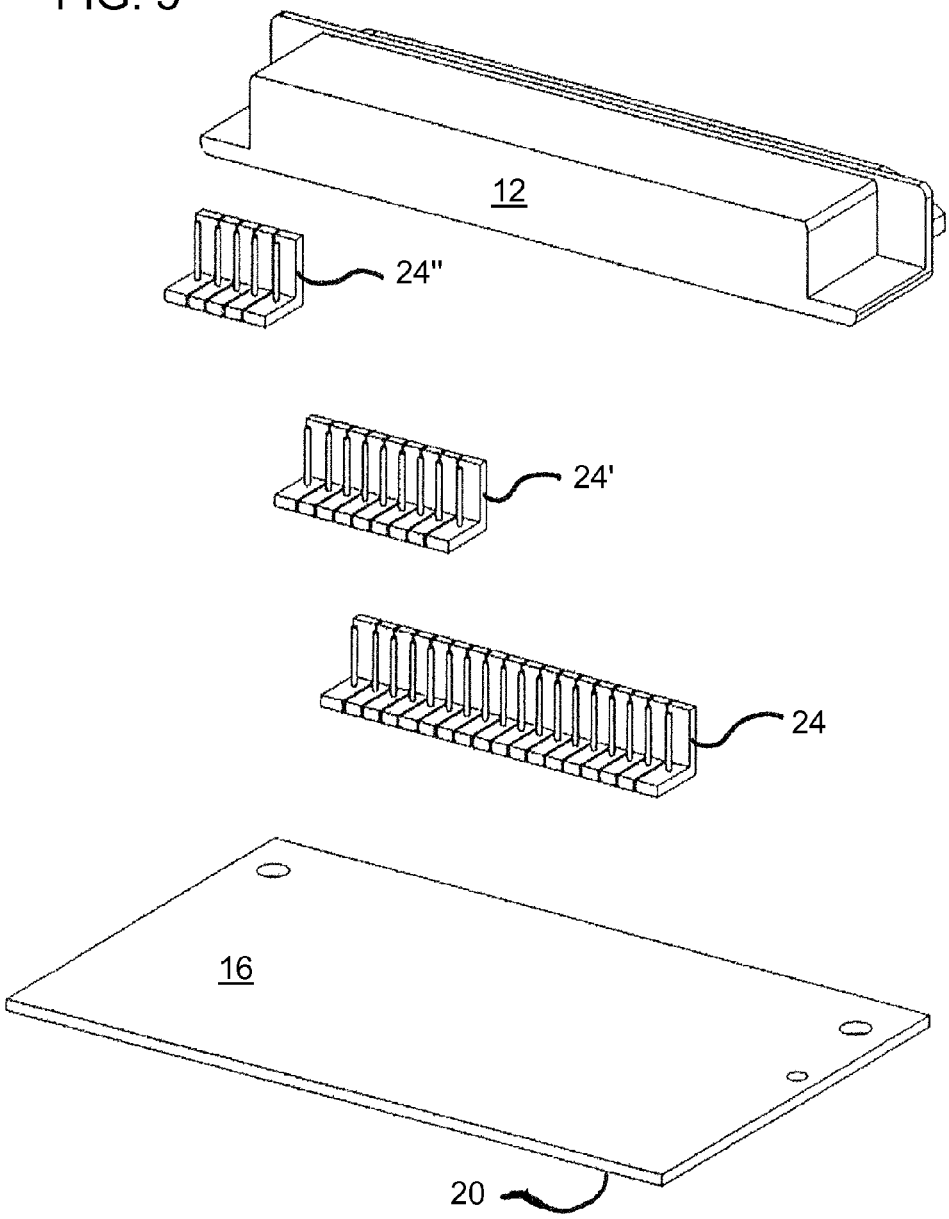
FIG. 5 is a schematic illustrating an exploded view of the adapter of FIG. 1 according to aspects of embodiments and/or embodiments of the present invention.

Accordingly, some aspects of embodiments and embodiments of the present invention provide an adapter 10 further might include guidance indicia 20 adapted to provide guidance for the mechanical communication of the third plurality of electrical conductors 32 to the one of the plug 24 and the socket 26 of the second connector 14 to facilitate electrical communication of the third plurality of electrical conductors 32 with the first portion 18 of the first plurality of pins or sockets 22 of the first connector 12 in the predetermined pinout to facilitate electrical communication among preselected equipment 34 associated with a preselected hospital bed 36 and a preselected nurse call station 40 as shown in FIG. 4. The table above is an example of such guidance to indicia 20.

As can be seen in FIG. 1, FIG. 3, and FIG. 6, some other aspects of embodiments and embodiments of the present invention provide further including a third connector 14' and a fourth connector 14". The third connector 14' has a plug 24' and a socket 26'. Each of the plug 24' and socket 26' has a second plurality of pins or sockets 30'. One of the plug 24' and socket 26' of the third connector 14' is adapted to mechanically communicate with a second portion 17' of a third plurality of electrical conductors 32 to facilitate electrical communication. The other of the plug 24' and the socket 26' of the third connector 14' is adapted to electrically communicate with a second portion 18' of the first plurality of pins or sockets 22 of the first connector 12. The component 16 includes a plurality of conductors 28 adapted for facilitating the other of the plug 24 and the socket 26 of the third connector 14' to electrically communicate with the second portion 18' of the first plurality of pins or sockets 22 of the first connector 12 in a first predetermined pinout. The fourth connector 14" has a plug 24" and a socket 26". Each of the plug 24'v and socket 26" has a third plurality of pins or sockets 30". One of the plug 24" and socket 26" of the fourth connector 14' is adapted to mechanically communicate with a third portion 17" of a third plurality of electrical conductors 32 to facilitate electrical communication. The other of the plug 24' and the socket 26' of the fourth connector 14' is adapted to electrically communicate with a third portion 18" of the first plurality of pins or sockets 22 of the first connector 12. Again, the component 16 includes a third plurality of conductors 28 adapted for facilitating the other of the plug 24 and the socket 26 of the fourth connector 14" to electrically communicate with the third portion 18" of the first plurality of pins or sockets 22 of the first connector 12 in a first predetermined pinout.

As can be seen in FIG. 1, FIG. 3, FIG. 6, and FIG. 8, still yet other aspects of embodiments and embodiments of the present invention provide that the first connector 12 be a D-subminiature connector.

As another example as shown in FIG. 1, FIG. 3, FIG. 5, FIG. 6, FIG. 7, and FIG. 8, aspects of embodiments and embodiments of the present invention, any one of the second connector 14, the third connector 14', the fourth connector 14", or any combinations thereof, includes an insulation-displacement connector (IDC connector) or insulation-piercing connectors (IPC connector). Corresponding tooling 48 such, MTA-100 tooling is commercially available from Carlton-Bates of Little Rock, Ark., USA (http://www.carlton-bates.com/index.shtml).

As yet another example as shown in FIG. 1, FIG. 3, FIG. 5, FIG. 6, FIG. 7, and FIG. 8, aspects of embodiments and embodiments, the component 16 comprising a plurality of conductors comprises a printed circuit board (PCB).

As still yet another example, aspects of embodiments and embodiments, the indicia 20 adapted to provide guidance comprises a cross-reference between the pins or sockets the second connector 14 and a color of the third plurality of electrical conductors 32.

As even still yet another example, aspects of embodiments and embodiments, the third plurality of electrical conductors 32 comprise a plurality of cables and the indicia 20 adapted to provide guidance comprises a cross-reference between a color of the electrical conductors of each cable of the plurality of cables and the pins or sockets each of the second 14, third 14', and fourth 14" connectors.

FIG. 4 is a schematic illustrating a use of the adapter 10 of FIG. 1 to electrically communicate with a nurse call station 40 electrically communicating with a plurality of hospital peripherals 44, 44', 44", 44", 44'", and 44"" according to aspects of embodiments and/or embodiments of the present invention. However, FIG. 4 also illustrates why prior to the present invention, a skilled personal would require several hours to replace a worn and/or damaged connector. Namely, FIG. 4 shows that one make and model of nurse call station 40 removed from the wall with not only the third plurality of electrical conductors 32 from the worn and/or damaged connector but also the plurality of electrical conductors 54, 54', 54", 54", 54'", and 54"" corresponding to the plurality of hospital peripherals 44, 44', 44", 44", 44'", and 44"" (e.g., without limitation, include nurse and/or aide in the room station, dome light, code blue station, bath help station, emergency pull station, staff station, house keeping station, remote reset station, etc.).

Given that the third plurality of electrical conductors 32 can be 37 or more and if each of the plurality of hospital peripherals 44, 44', 44", 44", 44'", and 44"" includes at least three conductors, conservatively, the number of conductors at a nurse call station 40 can be about 55. Applicant has encountered makes and models of nurse call stations 40 with to about 100 or more conductors. Just these number of conductors at a make and model of a nurse call stations 40 explains why unskilled and semi-skilled personal are incapable of replacing a connector having a plurality of pins or sockets electrically communicating through a plurality of electrical conductors in a predetermined pinout to facilitate electrical communication among preselected equipment 34 associated with a preselected hospital bed 36 (e.g., Stryker Medical, Portage, Mich., USA: see e.g., http://www.stryker.com/en-us/products/PatientHandlingEMSandEvacuationEquipment/Beds/index.htm and http://www.stryker.com/stellent/groups/jsp/documents/adacct/056403.pdf as well as Hill-Rom Corporate Offices, Batesville, Ind., USA: http://www.hill-rom.com/usa/index.asp and http://www.hill-rom.com/usa/PDF/CTG271.pdf) and a preselected nurse station 40 (see e.g., Rauland-Borg Corporation, Mount Prospect, Ill., USA: http://www.rauland.com/index.cfm; Jeron Electronic Systems, Inc., Chicago, Ill., USA: http://www.jeron.com/; TekTone® Sound & Signal Mfg., Inc., Franklin, N.C., USA: http://www.tektone.com/index.htm; and Hill-Rom Corporate Offices, Batesville, Ind., USA: http://www.hill-rom.com/usa/NaviCare_NurseCall.htm that are merely four out of a possibility of about 25). Adding the further possibility of different makes and models of hospital beds 36 combined with different makes and models of nurse call stations 40 further combined with different hospital peripherals 44, 44', 44", 44", 44'", and 44"" and again explains the challenges encountered by skilled personal.

FIG. 6 is schematic illustrating an adapter 10 of according to aspects of embodiments and/or embodiments of the present invention. Specifically, an adapter 10 was made using a type D sub connector having 37 contacts (Manufacturer Part No: 8LCM037S-304B-XX MULTICOMP, available from Newark of Chicago, Ill., USA as Part Number: 26M7826: see http://www.newark.com/multicomp/81 cm037s-304b-xx/socket-d-pcb-r-a-37way/dp/26M7826?Ntt=26M7826) and three different IDC connectors (5 Pin Connector CE-100-F-24-5-C; 8 Pin Connector CE-100-F-24-8-C; and 18 Pin Connector CE-100-F-24-18-C connect directly to their respective portions 18, 18', and 18" of the third plurality of electrical conductors 32 and called one of socket 26, 26', and 26" and plug 24, 24', & 24") and their complementary IDC heddars (5 Pin hedder M-L-SS-100-5-C; 8 Pin Hedder M-L-SS-100-8-C; 18 Pin hedder M-L-SS-100-18-C, available from Carlton-Bates of Little Rock, Ark., USA (http://www.carlton-bates.com/index.shtml) connect directly to their respective portions 17, 17', and 17" of the plurality of conductors 28 of component 16 and called the other of socket 26, 26', and 26" and plug 24, 24', & 24") each mounted on a printed circuit broad configured with the plurality of conductors 28.

FIG. 8 is schematic illustrating an adapter 10 of according to aspects of embodiments and/or embodiments of the present invention. Specifically, an adapter 10 was made using a type D sub connector having 37 contacts (Manufacturer Part No: 8LCM037S-304B-XX MULTICOMP, available from Newark of Chicago, Ill., USA as Part Number: 26M7826: see http://www.newark.com/multicomp/81 cm037s-304b-xx/socket-d-pcb-r-a-37way/dp/26M7826?Ntt=26M7826), an IDC connectors (20 Pin Connector CE-100-F-24-20-C connect directly to it respective portion 18 of the third plurality of electrical conductors 32 and called one of socket 26, 26', and 26" and plug 24, 24', & 24") and its complementary IDC heddar (20 Pin Hedder M-L-SS-100-20-C, available from Carlton-Bates of Little Rock, Ark., USA (http://www.carlton-bates.com/index.shtml) connect directly to its respective portions 17 of the plurality of conductors 28 of component 16 and called the other of socket 26, 26', and 26" and plug 24, 24', & 24") appropriately mounted on a printed circuit broad configured with the plurality of conductors 28.

In operation, aspects of embodiments and embodiments of the present invention the first repair and/or replacement of worn and/or damaged connector can be quickly and easily performed by even unskilled personnel. That is, unskilled personnel, rather than recording the connection sequenced of the plurality of electrical conductors to the nurse call station 40, merely cuts the plurality of electrical conductors 32 at the mounting location on a lower portion of a wall at about shin level, removes the worn or damaged connecter but not its associated plurality of electrical conductors 32, provides a new adapter 10, reconnects the associated plurality of electrical conductors 32 to the new adapter 10 according to indicia 20 sequenced using the tool 48, and replaces the new adapter 10 including the new connector 12. This process will have taken less than about 10 minutes. Subsequent repair and/or replacement of a worn and/or damaged connector can be performed by unskilled personnel even more quickly, i.e., less than 5 minutes, while requiring no previous knowledge of the adapter 10 or call station 40, and no special tools.

Other than in the operating examples, or where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by an aspect of an embodiment and/or embodiments of the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

ITEM LIST

Adapter 10
First connector 12
Second connector 14
Third connector 14'
Fourth connector 14"
Component 16 comprising a plurality of conductors 28
First portion 17 of a third plurality of electrical conductors 32
Second portion 17' of a third plurality of electrical conductors 32
Third portion 17" of a third plurality of electrical conductors 32
Indicia 20
First portion 18 of the first plurality of pins or sockets 22
Second portion 18' of the first plurality of pins or sockets 22
Third portion 18" of the first plurality of pins or sockets 22
First plurality of pins or sockets 22
Plug 24, 24', 24"
Socket 26, 26', 26"
Plurality of conductors 28
Second plurality of pins or sockets 30
Third plurality of pins or sockets 30'
Fourth plurality of pins or sockets 30"
Third plurality of electrical conductors 32
Preselected equipment 34
Preselected hospital bed 36
First predetermined pinout 38
Preselected nurse call station 40
Plurality of cables 42
Peripherals 44, 44', 44", 44'", 44"", 44"""
Ground 46
Tool 48 adapted to facilitate a mechanical communication
Kit 50

While typical embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present invention. By way of example, adaptors 10 for any one of:

Excel Digital, Hill-Rom 37-Pin, Nurse, TV, Vol., 10-Key, 2 Lights, Version 2
Excel Digital, Hill-Rom 37-Pin, Nurse, TV, Vol., 10-Key, 2 Lights, Version 3
Excel Digital, Hill-Rom 37-Pin, Nurse, TV, Vol., 10-Key, 2 Lights, Version 4
Excel Digital, Hill-Rom 37-Pin, Nurse, TV, Vol., 10-Key, 2 Lights, Version 5
Excel Digital, Hill-Rom 37-Pin, Nurse, TV, Vol., 10-Key, 2 Lights, Version 6
Excel Digital, Hill-Rom 37-Pin, Nurse, TV, Vol., 10-Key, Version 2
Excel Digital, Hill-Rom 37-Pin, Nurse, TV, Vol., Channel UP/DN
Excel Digital, Hill-Rom 37-Pin, Nurse, TV, Vol., Channel UP/DN, 2 Lights
Excel Digital, Hill-Rom 37-Pin, Nurse, TV, Vol., Channel UP/DN, 2 Lights, Version 2
Excel Digital, Hill-Rom 37-Pin, Nurse, TV, Vol., Channel UP/DN, 2 Lights, Version 3
Excel Digital, Hill-Rom 37-Pin, Nurse, TV, Vol., Channel UP/DN, 2 Lights, Version 4
Excel Digital, Hill-Rom 37-Pin, Nurse, TV, Vol., Channel UP/DN, Version 2
Excel Entertainir, Hill-Rom 37-Pin, Nurse, TV, Vol., 10-Key & DVD/VCR, 2 Lights
Excel Entertainir, Hill-Rom 37-Pin, Nurse, TV, Vol., 10-Key & DVD/VCR, 2 Lights (Version 2)
Excel Entertainir, Hill-Rom 37-Pin, Nurse, TV, Vol., 10-Key, 1 Light
Excel Entertainir, Hill-Rom 37-Pin, Nurse, TV, Vol., 10-Key, 2 Lights
Excel Entertainir, Hill-Rom 37-Pin, Nurse, TV, Vol., 10-Key, 2 Lights (Version 2)
Excel Entertainir, Hill-Rom 37-Pin, Nurse, TV, Vol., 10-Key, 2 Lights (Version 3)
Excel Entertainir, Hill-Rom 37-Pin, Nurse, TV, Vol., 10-Key, 2 Lights (Version 4)
Excel Entertainir, Hill-Rom 37-Pin, Nurse, TV, Vol., 10-Key, 2 Lights (Version 5)
Excel Entertainir, Hill-Rom 37-Pin, Nurse, TV, Vol., 10-Key, 2 Lights (Version 6)
Excel Entertainir, Hill-Rom 37-Pin, Nurse, TV, Vol., 10-Key, 2 Lights, Radio
Excel LT, Hill-Rom 37-Pin, Nurse, TV, Vol.
Excel LT, Hill-Rom 37-Pin, Nurse, TV, Vol., 2 Lights
Excel LT, Hill-Rom 37-Pin, Nurse, TV, Vol., 2 Lights, Radio
Excel Digital, Hill-Rom 37-Pin, Nurse, TV, Vol. (POT), 10-Key
Excel Digital, Hill-Rom 37-Pin, Nurse, TV, Vol. (POT), 10-Key, 2 Lights
Excel Digital, Hill-Rom 37-Pin, Nurse, TV, Vol. (POT), 10-Key, 2 Lights, Version 2
Excel Digital, Hill-Rom 37-Pin, Nurse, TV, Vol. (POT), 10-Key, 2 Lights, Version 3
Excel Digital, Hill-Rom 37-Pin, Nurse, TV, Vol. (POT), 10-Key, 2 Lights, Version 4
Excel Digital, Hill-Rom 37-Pin, Nurse, TV, Vol. (POT), Channel UP/DN
Excel Digital, Hill-Rom 37-Pin, Nurse, TV, Vol. (POT), Channel UP/DN, 2 Lights
Excel Digital, Hill-Rom 37-Pin, Nurse, TV, Vol., 10-Key
Excel Digital, Hill-Rom 37-Pin, Nurse, TV, Vol., 10-Key, 2 Lights
Excel Digital, Hill-Rom 37-Pin, Nurse, TV, Vol., 10-Key, 2 Lights, Radio
Excel Digital, Hill-Rom 37-Pin, Nurse, TV, Vol., 10-Key, 2 Lights, Radio, Version 2
Excel Digital, Hill-Rom 37-Pin, Nurse, TV, Vol., 10-Key, 2 Lights, Radio, to Version 3

. . . etc. might be configured and made.

It should be understood that all such modifications and improvements have been deleted herein for the sake of conciseness and readability but are properly within the scope of the following claims.

The invention claimed is:

1. An adapter including (a) a first connector comprising a D-subminiature connector having a first plurality of pins or sockets;

(b) a second connector having:

(i) a plug, (ii) a socket, and (iii) each plug and socket having a second plurality of pins or sockets, a. wherein one of the plug and the socket of the second connector is adapted to mechanically communicate with a first portion of a third plurality of electrical conductors to facilitate electrical communication while b. the other of the plug and the socket of the second connector is adapted to electrically communicate with a first portion of the first plurality of pins or sockets of the first connector; and (c) a component comprising a plurality of conductors adapted for facilitating the other of the plug and the socket of the second connector to electrically communicate with the first portion of the first plurality of pins or sockets of the first connector in a first predetermined pinout.

2. The adapter according to claim 1, further including indicia adapted to provide guidance for the mechanical communication of the third plurality of electrical conductors to the one of the plug and the socket of the second connector to facilitate electrical communication of the third plurality of electrical conductors with the first portion of the first plurality of pins or sockets of the first connector in the predetermined pinout to facilitate electrical communication among preselected equipment associated with a preselected hospital bed and a preselected nurse call station.

3. The adapter according to claim 1, further including:

(d) a third connector having:

(i) a plug, (ii) a socket, and (iii) each plug and socket having a third plurality of pins or sockets, a. wherein one of the plug and the socket of the third connector is adapted to mechanically communicate with a second portion of the third plurality of electrical conductors to facilitate electrical communication while b. the other of the plug and the socket of the third connector is adapted to electrically communicate with a second portion of the first plurality of pins or sockets of the first connector;

(e) a forth connector having:

(i) a plug, (ii) a socket, and (iii) each plug and socket having a forth plurality of pins or sockets, a. wherein one of the plug and the socket of the fourth connector is adapted to mechanically communicate with a third portion of the third plurality of electrical conductors to facilitate electrical communication while b. the other of the plug and the socket of the fourth connector is adapted to electrically communicate with a third portion of the first plurality of pins or sockets of the first connector; and (f) indicia adapted to provide guidance for the mechanical communication of the third plurality of electrical conductors to the one of the plug and the socket of the second, third, and fourth connectors to facilitate electrical communication of the third plurality of electrical conductors with the first, second, and third portions of the first plurality of pins or sockets of the first connector in the predetermined pinout to facilitate electrical communication among preselected equipment associated with a preselected hospital bed and a preselected nurse call station, wherein the component comprising the plurality of conductors is adapted for facilitating the other of the plug and the socket of the second, third, and fourth connectors to electrically communicate with the first, second, and third portions of the first plurality of pins or sockets of the first connector in a first predetermined pinout.

4. The adapter according to claim 3, wherein any one of the third connecter, the fourth connector, or the third and fourth connectors comprise any one of an insulation-displacement connector (IDC connector) or insulation-piercing connector (IPC connector).

5. The adapter according to claim 1, wherein the second connector comprises an insulation-displacement connector (IDC connector) or insulation-piercing connector (IPC connector).

6. The adapter according to claim 1, wherein the component comprising a plurality of conductors comprises a printed circuit board (PCB).

7. The adapter according to claim 1, wherein the indicia adapted to provide guidance comprises a cross-reference between the pins or sockets the second connector and a color of the third plurality of electrical conductors.

8. The adapter according to claim 3, wherein the third plurality of electrical conductors comprise a plurality of cables and wherein the indicia adapted to provide guidance comprises a cross-reference between a color of the electrical conductors of each cable of the plurality of cables and the pins or sockets each of the second, third, and fourth conductors.

9. A kit including:

(a) an adapter including:

(i) a first connector comprising a D-subminiature connector having a first plurality of pins or sockets;

(ii) a second connector having a. a plug, b. a socket, and c. each having a second plurality of pins or sockets, i. wherein one of the plug and the socket of the second connector is adapted to mechanically communicate with a first portion of a third plurality of electrical conductors to facilitate electrical communication while ii. the other of the plug and the socket of the second connector is adapted to electrically communicate with a first portion of the first plurality of pins or sockets of the first connector;

(iii) a component comprising a plurality of conductors adapted for facilitating the other of the plug and the socket of the second connector to electrically communicate with the first portion of the first plurality of pins or sockets of the first connector in a first predetermined pinout; and, optionally, (b) a tool adapted to facilitate a mechanical communication of a third plurality of electrical conductors to one of a plug and a socket of a second connector to facilitate electrical communication of the third plurality of electrical conductors with a first portion of a first plurality of pins or sockets of a first connector.

10. A kit according to claim 9, further including indicia adapted to provide guidance for the mechanical communication of the third plurality of electrical conductors to the one of the plug and the socket of the second connector to facilitate electrical communication of the third plurality of electrical conductors with the first portion of the first plurality of pins or sockets of the first connector in the predetermined pinout to facilitate electrical communication among preselected equipment associated with a preselected hospital bed and a preselected nurse call station.

11. The kit according to claim 9, wherein the adapter further includes:

(iv) a third connector having:

a. a plug, b. a socket, and c. each plug and socket having a third plurality of pins or sockets, i. wherein one of the plug and the socket of the third connector is adapted to mechanically communicate with a second portion of the third plurality of electrical conductors to facilitate electrical communication while ii. the other of the plug and the socket of the third connector is adapted to electrically communicate with a second portion of the first plurality of pins or sockets of the first connector;

(v) a fourth connector having:

a. a plug, b. a socket, and c. each plug and socket having a fourth plurality of pins or sockets, i. wherein one of the plug and the socket of the fourth connector is adapted to mechanically communicate with a third portion of the third plurality of electrical conductors to facilitate electrical communication while ii. the other of the plug and the socket of the fourth connector is adapted to electrically communicate with a third portion of the first plurality of pins or sockets of the first connector; and (vi) indicia adapted to provide guidance for the mechanical communication of the third plurality of electrical conductors to the one of the plug and the socket of the second, third, and fourth connectors to facilitate electrical communication of the third plurality of electrical conductors with the first, second, and third portions of the first plurality of pins or sockets of the first connector in the predetermined pinout to facilitate electrical communication among preselected equipment associated with a preselected hospital bed and a preselected nurse call station, wherein the component comprising the plurality of conductors is adapted for facilitating the other of the plug and the socket of the second, third, and fourth connectors to electrically communicate with the first, second, and third portions of the first plurality of pins or sockets of the first connector in a first predetermined pinout.

12. The kit according to claim 11, wherein any one of the third connecter, the fourth connector, or the third and fourth connectors comprise any one of an insulation-displacement connector (IDC connector) or insulation-piercing connector (IPC connector).

13. The kit according to claim 9, wherein the second connector comprises an insulation-displacement connector (IDC connector) or insulation-piercing connector (IPC connector).

14. The kit according to claim 9, wherein the component comprising a plurality of conductors comprises a printed circuit board (PCB).

15. The kit according to claim 9, wherein the indicia adapted to provide guidance comprises a cross-reference between the pins or sockets of the second connector and a color of the third plurality of electrical conductors.

16. The kit according to claim 11, wherein the third plurality of electrical conductors comprise a plurality of cables and wherein the indicia adapted to provide guidance comprises a cross-reference between a color of the electrical conductors of each cable of the plurality of cables and the pins or sockets each of the second, third, and fourth conductors.

17. A method for replacing a connector adapted to facilitate the electrical communication among preselected equipment associated with a preselected hospital bed and a preselected nurse, the method including:

(a) providing an adapter, wherein the adapter includes:

(i) a first connector comprising a D-subminiature connector having a first plurality of pins or sockets;

(ii) a second connector having:

a. a plug, b. a socket, and c. each having a second plurality of pins or sockets, i. wherein one of the plug and the socket of the second connector is adapted to mechanically communicate with a first portion of a third plurality of electrical conductors to facilitate electrical communication while ii. the other of the plug and the socket of the second connector is adapted to electrically communicate with a first portion of the first plurality of pins or sockets of the first connector; and (iii) a component comprising a plurality of conductors adapted for facilitating the other of the plug and the socket of the second connector to electrically communicate with the first portion of the first plurality of pins or sockets of the first connector in a first predetermined pinout; and (b) communicating the third plurality of electrical conductors to the one of the plug and the socket of the second connector mechanical in a manner of the indicia.

18. The method according to claim 17, further comprising providing indicia adapted to provide guidance for the mechanical communication of the third plurality of electrical conductors to the one of the plug and the socket of the second connector to facilitate electrical communication of the third plurality of electrical conductors with the first portion of the first plurality of pins or sockets of the first connector in the predetermined pinout to facilitate electrical communication among preselected equipment associated with a preselected hospital bed and a preselected nurse call station, wherein the communicating the third plurality of electrical conductors to the one of the plug and the socket of the second connector mechanical is in a manner consistent with the indicia.

19. The method according to claim 17, wherein any one of:

(α) the second connector comprises an insulation-displacement connector (IDC connector) or insulation-piercing connector (IPC connector);

(β) the component comprising a plurality of conductors comprises a printed circuit board (PCB); or (χ) the second connector comprises an insulation-displacement connector (IDC connector) or insulation-piercing connector (IPC connector) and the component comprising a plurality of conductors comprises a printed circuit board (PCB).

20. The method according to claim 18, wherein any one of:

(δ) the indicia adapted to provide guidance comprises a cross-reference between the pins or sockets of the second connector and a color of the third plurality of electrical conductors;

(ϵ) the third plurality of electrical conductors comprise a plurality of cables and wherein the indicia adapted to provide guidance comprises a cross-reference between a color of the electrical conductors of each cable of a plurality of cables and the pins or sockets of each of the second conductor, a third conductor, and a fourth conductor; or (ϕ) both.

21. The method according to claim 17, wherein the adapter further includes:

(iv) a third connector having:

a. a plug, b. a socket, and c. each plug and socket having a third plurality of pins or sockets, i. wherein one of the plug and the socket of the third connector is adapted to mechanically communicate with a second portion of the third plurality of electrical conductors to facilitate electrical communication while ii. the other of the plug and the socket of the third connector is adapted to electrically communicate with a second portion of the first plurality of pins or sockets of the first connector;

(v) a fourth connector having:

a. a plug, b. a socket, and c. each plug and socket having a fourth plurality of pins or sockets, i. wherein one of the plug and the socket of the fourth connector is adapted to mechanically communicate with a third portion of the third plurality of electrical conductors to facilitate electrical communication while ii. the other of the plug and the socket of the fourth connector is adapted to electrically communicate with a third portion of the first plurality of pins or sockets of the first connector; and (vi) indicia adapted to provide guidance for the mechanical communication of the third plurality of electrical conductors to the one of the plug and the socket of the second, third, and fourth connectors to facilitate electrical communication of the third plurality of electrical conductors with the first, second, and third portions of the first plurality of pins or sockets of the first connector in the predetermined pinout to facilitate electrical communication among preselected equipment associated with a preselected hospital bed and a preselected nurse call station, wherein the component comprising the plurality of conductors is adapted for facilitating the other of the plug and the socket of the second, third, and fourth connectors to electrically communicate with the first, second, and third portions of the first plurality of pins or sockets of the first connector in a first predetermined pinout.

22. The kit according to claim 21, wherein any one of the third connecter, the fourth connector, or the third and fourth connectors comprise any one of an insulation-displacement connector (IDC connector) or insulation-piercing connector (IPC connector).

23. An adapter including (a) a first connector having a first plurality of pins or sockets;

(b) a second connector having:

(i) a plug, (ii) a socket, and (iii) each plug and socket having a second plurality of pins or sockets, a. wherein one of the plug and the socket of the second connector is adapted to mechanically communicate with a first portion of a third plurality of electrical conductors to facilitate electrical communication while b. the other of the plug and the socket of the second connector is adapted to electrically communicate with a first portion of the first plurality of pins or sockets of the first connector, wherein the second connector comprises an insulation-displacement connector (IDC connector) or insulation-piercing connector (IPC connector); and (c) a component comprising a plurality of conductors adapted for facilitating the other of the plug and the socket of the second connector to electrically communicate with the first portion of the first plurality of pins or sockets of the first connector in a first predetermined pinout.

24. The adapter according to claim 23, further including indicia adapted to provide guidance for the mechanical communication of the third plurality of electrical conductors to the one of the plug and the socket of the second connector to facilitate electrical communication of the third plurality of electrical conductors with the first portion of the first plurality of pins or sockets of the first connector in the predetermined pinout to facilitate electrical communication among preselected equipment associated with a preselected hospital bed and a preselected nurse call station.

25. The adapter according to claim 23, further including:

(d) a third connector having:

(i) a plug, (ii) a socket, and (iii) each plug and socket having a third plurality of pins or sockets, a. wherein one of the plug and the socket of the third connector is adapted to mechanically communicate with a second portion of the third plurality of electrical conductors to facilitate electrical communication while b. the other of the plug and the socket of the third connector is adapted to electrically communicate with a second portion of the first plurality of pins or sockets of the first connector;

(e) a forth connector having:

(i) a plug, (ii) a socket, and (iii) each plug and socket having a forth plurality of pins or sockets, a. wherein one of the plug and the socket of the fourth connector is adapted to mechanically communicate with a third portion of the third plurality of electrical conductors to facilitate electrical communication while b. the other of the plug and the socket of the fourth connector is adapted to electrically communicate with a third portion of the first plurality of pins or sockets of the first connector; and (f) indicia adapted to provide guidance for the mechanical communication of the third plurality of electrical conductors to the one of the plug and the socket of the second, third, and fourth connectors to facilitate electrical communication of the third plurality of electrical conductors with the first, second, and third portions of the first plurality of pins or sockets of the first connector in the predetermined pinout to facilitate electrical communication among preselected equipment associated with a preselected hospital bed and a preselected nurse call station, wherein the component comprising the plurality of conductors is adapted for facilitating the other of the plug and the socket of the second, third, and fourth connectors to electrically communicate with the first, second, and third portions of the first plurality of pins or sockets of the first connector in a first predetermined pinout.

26. The adapter according to claim 25, wherein any one of the third connecter, the fourth connector, or the third and fourth connectors comprise any one of an insulation-displacement connector (IDC connector) or insulation-piercing connector (IPC connector).

27. The adapter according to claim 25, wherein any one of the second connector, the third connecter, and the fourth connector comprise one of an insulation-displacement connector (IDC connector) and insulation-piercing connector (IPC connector) and any two other of the second connector, the third connecter, and the fourth connector comprise the other of the insulation-displacement connector (IDC connector) and insulation-piercing connector (IPC connector).

28. The adapter according to claim 23, wherein the component comprising a plurality of conductors comprises a printed circuit board (PCB).

29. The adapter according to claim 23, wherein the indicia adapted to provide guidance comprises a cross-reference between the pins or sockets the second connector and a color of the third plurality of electrical conductors.

30. The adapter according to claim 25, wherein the third plurality of electrical conductors comprise a plurality of cables and wherein the indicia adapted to provide guidance comprises a cross-reference between a color of the electrical conductors of each cable of the plurality of cables and the pins or sockets each of the second, third, and fourth conductors.

31. A kit including:

(a) an adapter including:

(i) a first connector having a first plurality of pins or sockets;

(ii) a second connector having a. a plug, b. a socket, and c. each having a second plurality of pins or sockets, i. wherein one of the plug and the socket of the second connector is adapted to mechanically communicate with a first portion of a third plurality of electrical conductors to facilitate electrical communication while ii. the other of the plug and the socket of the second connector is adapted to electrically communicate with a first portion of the first plurality of pins or sockets of the first connector, wherein the second connector comprises an insulation-displacement connector (IDC connector) or insulation-piercing connector (IPC connector);

(iii) a component comprising a plurality of conductors adapted for facilitating the other of the plug and the socket of the second connector to electrically communicate with the first portion of the first plurality of pins or sockets of the first connector in a first predetermined pinout; and, optionally, (b) a tool adapted to facilitate a mechanical communication of a third plurality of electrical conductors to one of a plug and a socket of a second connector to facilitate electrical communication of the third plurality of electrical conductors with a first portion of a first plurality of pins or sockets of a first connector.

32. A kit according to claim 31, further including indicia adapted to provide guidance for the mechanical communication of the third plurality of electrical conductors to the one of the plug and the socket of the second connector to facilitate electrical communication of the third plurality of electrical conductors with the first portion of the first plurality of pins or sockets of the first connector in the predetermined pinout to facilitate electrical communication among preselected equipment associated with a preselected hospital bed and a preselected nurse call station.

33. The kit according to claim 31, wherein the adapter further includes:

(iv) a third connector having:

a. a plug, b. a socket, and c. each plug and socket having a third plurality of pins or sockets, i. wherein one of the plug and the socket of the third connector is adapted to mechanically communicate with a second portion of the third plurality of electrical conductors to facilitate electrical communication while ii. the other of the plug and the socket of the third connector is adapted to electrically communicate with a second portion of the first plurality of pins or sockets of the first connector;

(v) a fourth connector having:

a. a plug, b. a socket, and c. each plug and socket having a fourth plurality of pins or sockets, i. wherein one of the plug and the socket of the fourth connector is adapted to mechanically communicate with a third portion of the third plurality of electrical conductors to facilitate electrical communication while ii. the other of the plug and the socket of the fourth connector is adapted to electrically communicate with a third portion of the first plurality of pins or sockets of the first connector; and (vi) indicia adapted to provide guidance for the mechanical communication of the third plurality of electrical conductors to the one of the plug and the socket of the second, third, and fourth connectors to facilitate electrical communication of the third plurality of electrical conductors with the first, second, and third portions of the first plurality of pins or sockets of the first connector in the predetermined pinout to facilitate electrical communication among preselected equipment associated with a preselected hospital bed and a preselected nurse call station, wherein the component comprising the plurality of conductors is adapted for facilitating the other of the plug and the socket of the second, third, and fourth connectors to electrically communicate with the first, second, and third portions of the first plurality of pins or sockets of the first connector in a first predetermined pinout.

34. The kit according to claim 33, wherein any one of the third connecter, the fourth connector, or the third and fourth connectors comprise any one of an insulation-displacement connector (IDC connector) or insulation-piercing connector (IPC connector).

35. The kit according to claim 31, wherein any one of the second connector, the third connecter, and the fourth connector comprise one of an insulation-displacement connector (IDC connector) and insulation-piercing connector (IPC connector) and any two other of the second connector, the third connecter, and the fourth connector comprise the other of the insulation-displacement connector (IDC connector) and insulation-piercing connector (IPC connector).

36. The kit according to claim 31, wherein the component comprising a plurality of conductors comprises a printed circuit board (PCB).

37. The kit according to claim 31, wherein the indicia adapted to provide guidance comprises a cross-reference between the pins or sockets of the second connector and a color of the third plurality of electrical conductors.

38. The kit according to claim 33, wherein the third plurality of electrical conductors comprise a plurality of cables and wherein the indicia adapted to provide guidance comprises a cross-reference between a color of the electrical conductors of each cable of the plurality of cables and the pins or sockets each of the second, third, and fourth conductors.

39. A method for replacing a connector adapted to facilitate the electrical communication among preselected equipment associated with a preselected hospital bed and a preselected nurse, the method including:

(a) providing an adapter, wherein the adapter includes:
- (i) a first connector having a first plurality of pins or sockets;
- (ii) a second connector having:
  - a. a plug,
  - b. a socket, and
  - c. each having a second plurality of pins or sockets,
    - i. wherein one of the plug and the socket of the second connector is adapted to mechanically communicate with a first portion of a third plurality of electrical conductors to facilitate electrical communication while
    - ii. the other of the plug and the socket of the second connector is adapted to electrically communicate with a first portion of the first plurality of pins or sockets of the first connector, wherein the second connector comprises an insulation-displacement connector (IDC connector) or insulation-piercing connector (IPC connector); and
- (iii) a component comprising a plurality of conductors adapted for facilitating the other of the plug and the socket of the second connector to electrically communicate with the first portion of the first plurality of pins or sockets of the first connector in a first predetermined pinout; and (b) communicating the third plurality of electrical conductors to the one of the plug and the socket of the second connector mechanical in a manner of the indicia.

40. The method according to claim 39, further comprising providing indicia adapted to provide guidance for the mechanical communication of the third plurality of electrical conductors to the one of the plug and the socket of the second connector to facilitate electrical communication of the third plurality of electrical conductors with the first portion of the first plurality of pins or sockets of the first connector in the predetermined pinout to facilitate electrical communication among preselected equipment associated with a preselected hospital bed and a preselected nurse call station, wherein the communicating the third plurality of electrical conductors to the one of the plug and the socket of the second connector mechanical is in a manner consistent with the indicia.

41. The method according to claim 39, wherein any one of:

(α) the indicia adapted to provide guidance comprises a cross-reference between the pins or sockets of the second connector and a color of the third plurality of electrical conductors;

(β) the third plurality of electrical conductors comprise a plurality of cables and wherein the indicia adapted to provide guidance comprises a cross-reference between a color of the electrical conductors of each cable of a plurality of cables and the pins or sockets of each of the second conductor, a third conductor, and a fourth conductor; or (χ) both.

42. The method according to claim 40, wherein the adapter further includes:

(iv) a third connector having:
- a. a plug,
- b. a socket, and
- c. each plug and socket having a third plurality of pins or sockets,
  - i. wherein one of the plug and the socket of the third connector is adapted to mechanically communicate with a second portion of the third plurality of electrical conductors to facilitate electrical communication while
  - ii. the other of the plug and the socket of the third connector is adapted to electrically communicate with a second portion of the first plurality of pins or sockets of the first connector;

(v) a fourth connector having:
- a. a plug,
- b. a socket, and
- c. each plug and socket having a fourth plurality of pins or sockets,
  - i. wherein one of the plug and the socket of the fourth connector is adapted to mechanically communicate with a third portion of the third plurality of electrical conductors to facilitate electrical communication while
  - ii. the other of the plug and the socket of the fourth connector is adapted to electrically communicate with a third portion of the first plurality of pins or sockets of the first connector; and (vi) indicia adapted to provide guidance for the mechanical communication of the third plurality of electrical conductors to the one of the plug and the socket of the second, third, and fourth connectors to facilitate electrical communication of the third plurality of electrical conductors with the first, second, and third portions of the first plurality of pins or sockets of the first connector in the predetermined pinout to facilitate electrical communication among preselected equipment associated with a preselected hospital bed and a preselected nurse call station, wherein the component comprising the plurality of conductors is adapted for facilitating the other of the plug and the socket of the second, third, and fourth connectors to electrically communicate with the first, second, and third portions of the first plurality of pins or sockets of the first connector in a first predetermined pinout.

43. The kit according to claim 42, wherein any one of the third connecter, the fourth connector, or the third and fourth connectors comprise any one of an insulation-displacement connector (IDC connector) or insulation-piercing connector (IPC connector).

44. The kit according to claim 42, wherein any one of the second connector, the third connecter, and the fourth connector comprise one of an insulation-displacement connector (IDC connector) and insulation-piercing connector (IPC connector) and any two other of the second connector, the third connecter, and the fourth connector comprise the other of the insulation-displacement connector (IDC connector) and insulation-piercing connector (IPC connector).

* * * * *